US007090542B2

(12) United States Patent
Zheng et al.

(10) Patent No.: US 7,090,542 B2
(45) Date of Patent: Aug. 15, 2006

(54) MULTI-PORT MODULAR JACK ASSEMBLY WITH ACCURATE ASSEMBLYING MEANS

(75) Inventors: Qisheg Zheng, Kunsan (CN); Xin Shan Zhang, Kunsan (CN); Kai Kai Lu, Kunsan (CN); Zheng hua Xu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/852,839

(22) Filed: May 25, 2004

(65) Prior Publication Data

US 2004/0235345 A1 Nov. 25, 2004

(30) Foreign Application Priority Data

May 23, 2003 (TW) ..... 92209561 U

(51) Int. Cl.
*H01R 24/00* (2006.01)

(52) U.S. Cl. ..... 439/676

(58) Field of Classification Search ..... 439/490, 439/620, 107–108, 676, 95, 488–489, 83, 439/941, 607–610
See application file for complete search history.

(56) References Cited

U.S. PATENT DOCUMENTS

| | | | | |
|---|---|---|---|---|
| 6,511,348 | B1 * | 1/2003 | Wojtacki et al. | 439/620 |
| 6,688,909 | B1 * | 2/2004 | Espenshade et al. | 439/490 |
| 6,699,065 | B1 * | 3/2004 | Espenshade et al. | 439/490 |
| 6,736,673 | B1 * | 5/2004 | Simmons et al. | 439/541.5 |
| 6,736,680 | B1 * | 5/2004 | Slack et al. | 439/676 |
| 6,783,398 | B1 * | 8/2004 | Slack et al. | 439/620 |
| 6,896,542 | B1 * | 5/2005 | Chang | 439/490 |

* cited by examiner

*Primary Examiner*—J. F. Duverne
(74) *Attorney, Agent, or Firm*—Wei Te Chung

(57) ABSTRACT

A modular jack assembly (10) includes a number of connectors (1). Each connector includes at least one receiving cavity (24) for receive a mating connector, and a plurality of contacts (4) received in the connector. The modular jack assembly also includes an engager (3) mounted in front portions of the connectors to assemble the connectors together in side-by-side arrangement.

10 Claims, 4 Drawing Sheets

MULTI-PORT MODULAR JACK ASSEMBLY WITH ACCURATE ASSEMBLYING MEANS

BACKGROUND OF THE INVENTION

1. Field of the Invention

The present invention relates to an electrical connector, and more particularly to a multi-port modular jack assembly.

2. Description of the Prior Art

Modular jacks are commonly used in network communications. U.S. Pat. No. 6,227,911 issued to Boutros et al. disclose such modular jack assemblies with two rows of receiving cavities for connecting with a plurality of mating plugs. Each row of the receiving cavities is arranged along a longitudinal axis. However, a housing defining the receiving cavities is integrally made by insert-molding process. When it is desired to have different types of modular jacks with less or more receiving cavities, different types of moulds are needed, which is disadvantage for decrease manufacturing cost.

Hence, an improved modular jack assembly is needed to overcome the foregoing shortcomings.

BRIEF SUMMARY OF THE INVENTION

A main object of the present invention is to provide a multi-port modular jack assembly wherein the receiving cavities can be increased or decreased conveniently.

In order to achieve the object set forth, a modular jack assembly includes a number of connectors. Each connector includes at least a receiving cavity through a mating face for receive a mating connector, and a plurality of contacts received in the connector. The modular jack assembly also includes an engager mounted in front portions of the connectors and help to assembly the connectors together in side-by-side arrangement.

Other objects, advantages and novel features of the invention will become more apparent from the following detailed description when taken in conjunction with the accompanying drawings.

DETAILED DESCRIPTION OF THE INVENTION

Figure 1:
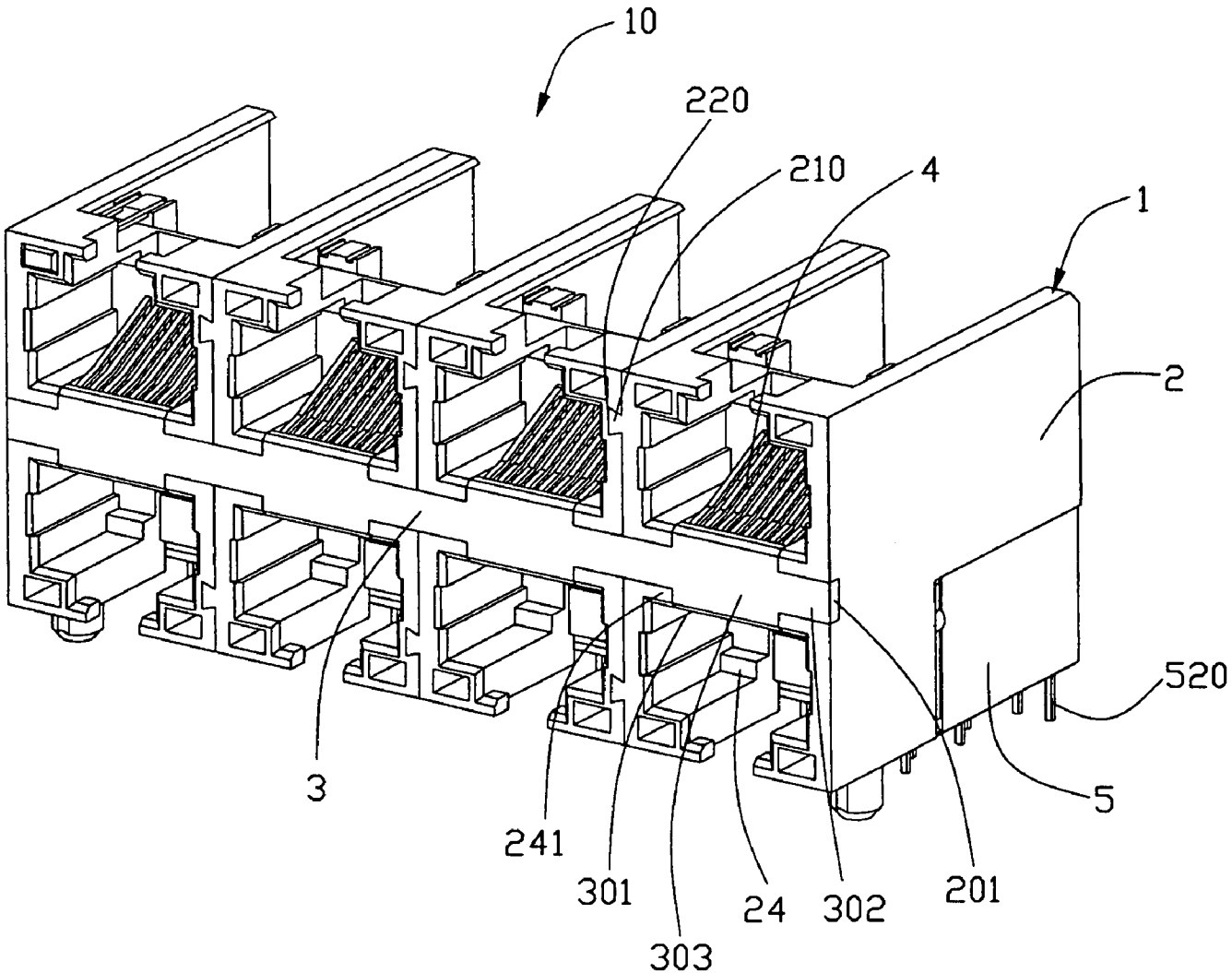
FIG. 1 is a perspective view of a multi-port modular jack assembly according to the present invention.
Figure 2:
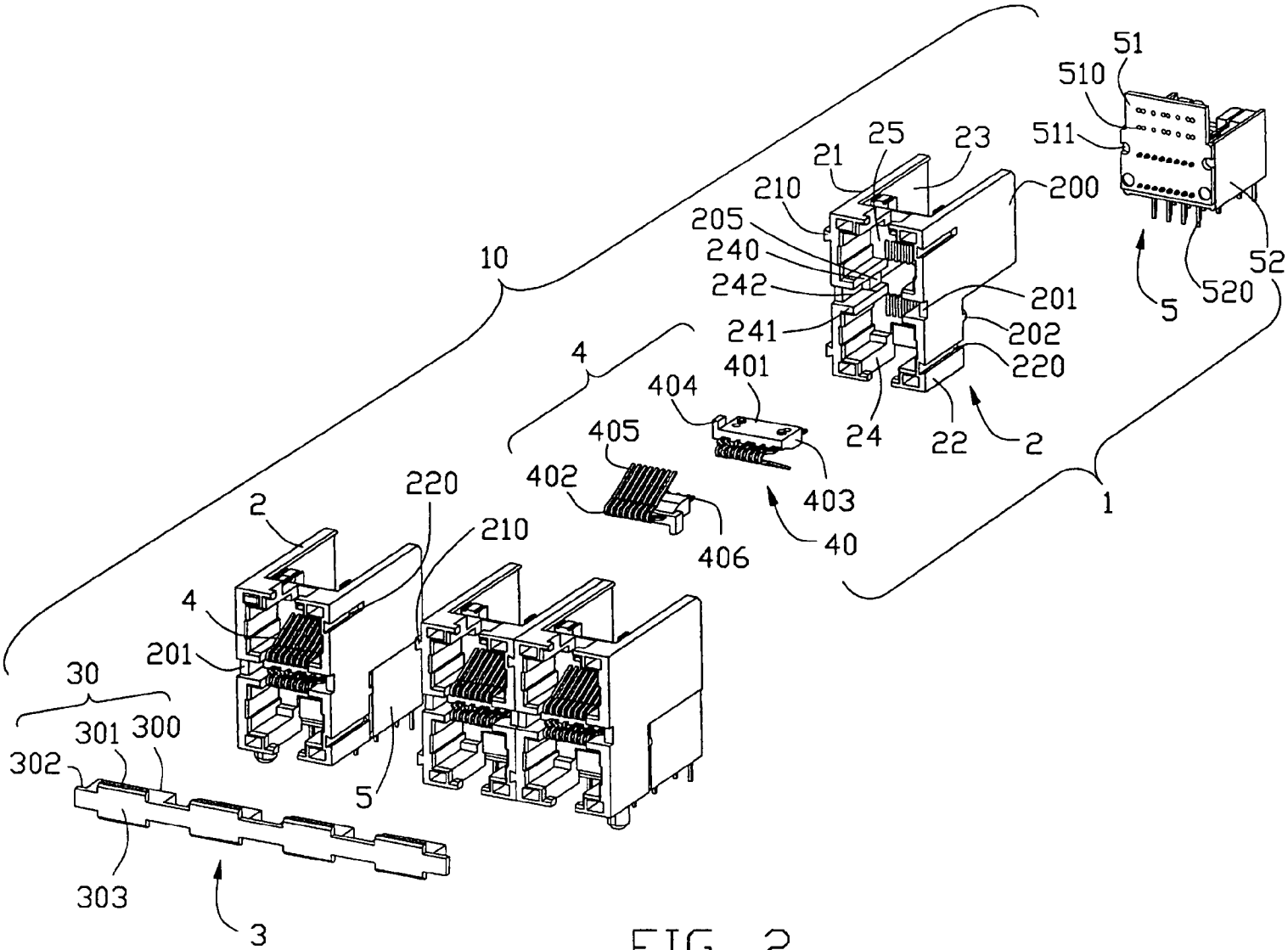
FIG. 2 is an exploded view of FIG. 1.
Figure 3:
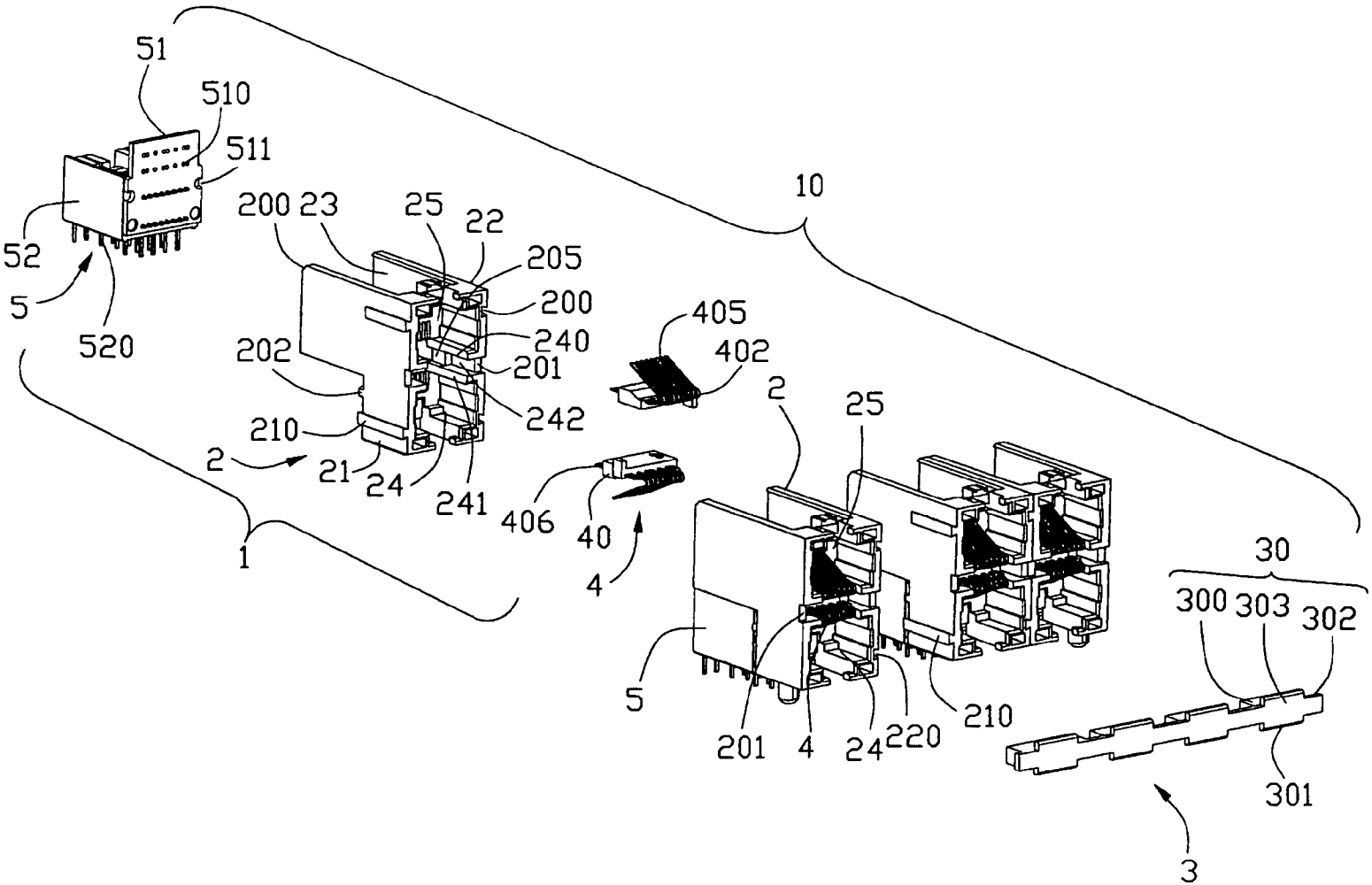
FIG. 3 is another exploded view of FIG. 1 from a different aspect.

Referring to FIGS. 1, 2 and 3, a multi-port modular jack assembly 10 comprises a plurality of single stacked connectors 1, an engager 3 which is unitarily formed with a plurality of engaging blocks 30. Each stacked connector 1 includes an insulative housing 2, a contact assembly 4 received in the housing 2, and an insert module 5 attached to a rear portion of the housing 2.

The housing 2 includes a pair of side walls 21, 22, a pair of extension walls 200 extending rearwardly from upper portions of the side walls 21, 22, a pair of stacked upper and lower receiving cavities 24 defined between the side walls 21, 22 and through a front face of the housing 2, and a rear cavity 23 defined between the extension walls 200. One of the side walls 21, 22 defines a pair of guiding bars 210 extending rearwardly in parallel on an outer surface of the left side wall 21. Accordingly, a pair of guiding recesses 220 are defined in an outer surface of the right side walls 22. The side walls 21, 22 define a pair of horizontal cutouts 201 in front portions thereof, a pair of holders 202 extending rearwardly therefrom, and upper and lower ribs 240, 241 formed on inner surfaces of the two side walls 21, 22 and adjacent to the upper and lower receiving cavities 24. A pair of grooves 242 are defined between the upper and lower ribs 240, 241. Each groove 242 is aligned with the cutouts 201 of the side walls 21, 22 respectively, and each of the groove 242 defines a barrier 205 in rear portion. A pair of baffles 25 is formed between each cavity 24 and the rear cavity 23. Each baffle 25 has a plurality of longitudinal slots (not labeled), and an opening (not labeled) is defined between the baffles 25.

Referring to FIGS. 2 and 3, the engager 3 is integrally formed with a plurality of engaging blocks 30. The engaging block 30 comprises a rectangular base 300, a pair of engaging pieces 301 extending upwardly and downwardly from a front face 303 of the base 300, and a pair of protuberances 302 protruding laterally from opposite ends of the base 300. Front faces of the base 300, the engaging pieces 301 and the protuberances 302 are in a common plane.

Figure 4:
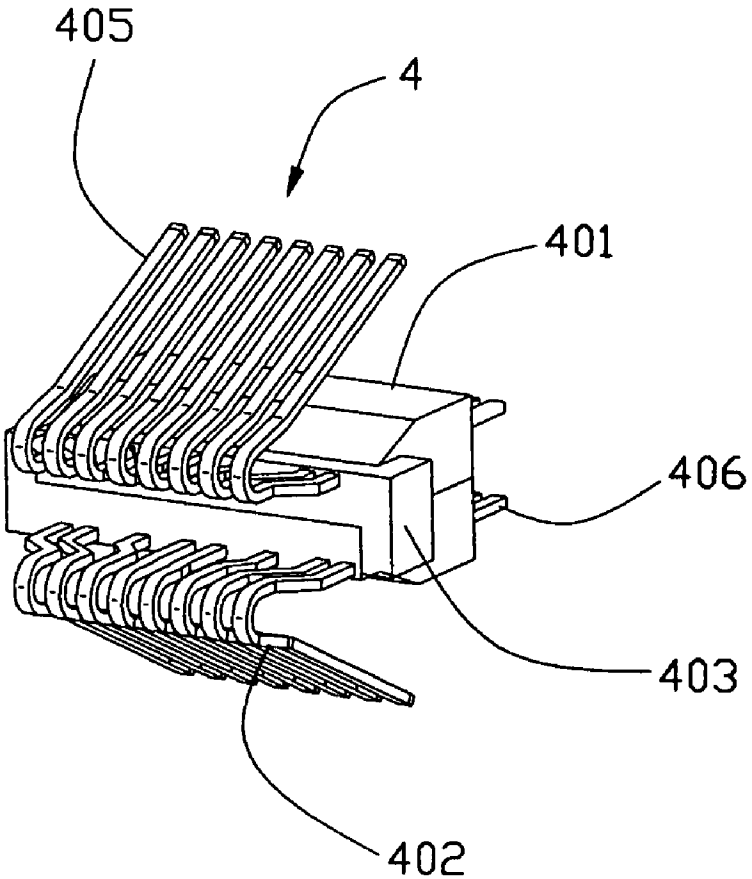
FIG. 4 is a perspective view of a contact assembly according to the present invention.

Referring to FIGS. 2, 3 and 4, the contact assembly 4 comprises two identical contact modules 40. Each contact module 40 includes a rectangular body 401 and a plurality of contacts 402 insert molding with the body 401. The body 401 is made up of insulate material, it provides a flat plane 403 on one side thereof, and an engaging button 404 extending upwardly from opposite side thereof. Each contact 402 provides a bended contact portion 405 extending from the front of the body 40, and a soldering portion 406 extending from the rearward of the body 40.

Referring to FIGS. 2 and 3, the insert module 5 comprises an interior circuit board 51 and a magnetic module 52. The circuit board 51 forms some electric traces (not shown), two rows of soldering holes 510 adapting to solder the soldering portions 406 therein, and a pair of arced holding holes 511 on both sides of thereof and adapted to mate with the holders 202 of the housing 2. The magnetic module 52 includes multiple soldering legs 520 extending downwardly for being soldered on an exterior circuit board (not shown).

In assembly, as shown in FIGS. 1 through 4, first turn one of the contact modules 40 over, the flat planes 403 of the contact modules 40 abut against each other tightly. Then the engaging button 404 of one contact module 40 engage with the flat plane 403 of the other contact module 40, whereby the contact modules 40 are assembled as a contact assembly 4. The contact assembly 4 is insert into the housing 2 from a front portion, the two engaging buttons 404 on both side of the contact assembly 4 slide along the two grooves 242 of both side walls 21, 22 of the housing 2 respectively, and stopped by the barrier 205. The soldering portion 406 of the contact 402 extends from the opening defined on rearward of the housing 2 to the rear cavity 23 thereof, and the contact portion 405 is received in corresponding slot of the baffles 25.

The insert module 5 is mounted in a rear portion of the housing 2. Both sides of the magnetic module 52 respectively engage with the extension walls 200 of the housing 2. The holder holes 511 in both sides of the interior circuit board 51 engage with the holder portions 202 on the rear portion of the housing 2. The soldering portions 406 of the contacts 402 are soldered in corresponding soldering holes 510 of the interior circuit board 51, and electrically connecting with the circuit traces thereon.

The guiding bars 210 of each housing 2 is received in corresponding recesses 220 of an adjacent housing 2, whereby a plurality of housings 2 are assembled together in side-by-side relationship.

The engager 3 is inserted from the front face of the housing 2. The two sides of the base 300 of each engaging block 30 are received in the two grooves 242 of both sides of the housing 2 respectively, and the two protuberances 302 respectively mate with the two cutouts 201 on both side walls of the housing 2. The rear face of the engaging block 30 resists the front face of the contact assembly 4, the two engaging pieces 301 mate with the upper and lower ribs 240, 241 defined in the cavity 24 of the housing 2 respectively, and the front face 303 aligns with the front portion of the housing 2 forming a planar front surface. Each engaging block 30 defined on the engager 3 mates with each housing 2, which makes a plurality of housings 2 aligned together side by side to form a modular jack assembly 10.

In the embodiment of the invention, the modular jack assembly 10 comprises four single stacked connectors 1 aligned side by side. In practice, it is only to change the number of mold of the housing 2 and the engaging block 30 in manufacture when need to increase or decrease the number of ports conveniently.

Certainly, there are some other embodiments of the invention, the multiple housing 2 of the modular jack assembly 10 could align by other means, and the single stacked connector 1 could be one port connector.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack assembly comprising:

a plurality of connectors each comprising at least one receiving cavity for receiving a mating connector and a plurality of contacts, each connector defining a pair of cutouts in front portion; and an engager removably mounted in front portions of the connectors and helping to assemble the connectors together in side-by-side arrangement, said engager insert molded with a plurality of engaging blocks, each engaging block mating with the cutout of a corresponding connector.

2. The modular jack assembly according to claim 1, wherein each connector includes an insulative housing, the housing having a pair of said walls, one of the side wall including at least one guiding bar on an outer surface thereof, and the other side wall defining a recess engaging with corresponding guiding bar of an adjacent connector.

3. The modular jack assembly according to claim 1, wherein a front face of the engager is in a common planar plane with the mating face of the connectors.

4. The modular jack assembly according to claim 3, wherein each connector defines pair of grooves in inner surfaces of the side walls of the housing and in communication with the cutout, each engaging black of the engager defining a base on rear portion, both skies of the base being respectively, the engaging block defining a pair of engaging pieces for mating with the ribs.

5. The modular jack assembly according to claim 4, wherein each connector defines a pair of ribs respectively on inner surfaces of both side walls of the housing, said grooves being formed between the ribs respectively, the engaging block defining a pair of engaging pieces for mating with the ribs.

6. The modular jack assembly according to claim 5, wherein the contacts are inserted molding with a rectangular body to form a contact assembly.

7. The modular jack assembly according to claim 6, wherein each connector defines two cavities in the front face of the housing for receiving a mating plug, the contact assembly and the engaging black being inserted into the housing between the two cavities.

8. The modular jack assembly according to claim 7, wherein the contact assembly defines a pair of engaging buttons extending from opposite sides, the buttons being received in corresponding grooves of the housing.

9. A modular connector assembly comprising:

a plurality of housing units side by side arranged with one another along a longitudinal direction of the whole connector assembly, each of said housing units defining at least a mating port along a front-to-back direction perpendicular to said longitudinal direction;

interengagement devices formed on two opposite sides of each of said housing units in said longitudinal direction to fasten the two neighboring housing unites together; and an integral engager extending along said longitudinal direction and across said housing units with means to engage the respective housing units so as to integrate said housing units as one piece, said engager insert molded with a plurality of engaging blocks each mating with a cutout of said corresponding housing unit.

10. A modular connector assembly comprising:

a plurality of housing units side by side arranged with one another along a longitudinal direction of the whole connector assembly, each of said housing units defining upper and lower mating port along a front to back direction perpendicular to said longitudinal direction; and an integral engager extending along said longitudinal direction and across said housing units with means to engage the respective housing units so as to integrate said housing units as one piece; wherein said integral engager is located between die upper mating port and the lower mating port of each of said housing units, said engager insert molded with a plurality of engaging blocks each mating with a cutout of the corresponding housing unit.

* * * * *